United States Patent [19]

Kuehnle

[11] 4,329,043

[45] May 11, 1982

[54] MULTIPLE COPY ELECTROPHOTOGRAPHIC REPRODUCING APPARATUS

[75] Inventor: Manfred R. Kuehnle, Lexington, Mass.

[73] Assignee: Coulter Systems Corporation, Bedford, Mass.

[21] Appl. No.: 180,701

[22] Filed: Aug. 25, 1980

Related U.S. Application Data

[60] Division of Ser. No. 909,433, May 25, 1978, Pat. No. 4,241,160, which is a continuation of Ser. No. 723,098, Sep. 14, 1976, abandoned, which is a continuation of Ser. No. 517,173, Oct. 23, 1974, abandoned.

[51] Int. Cl.[3] ..... G03G 15/00

[52] U.S. Cl. ..... 355/14 R; 355/3 R

[58] Field of Search ..... 355/3 R, 11, 16, 14 R; 430/31, 126; 101/DIG. 13

[56] References Cited

U.S. PATENT DOCUMENTS

| | | | |
|---|---|---|---|
| 2,951,443 | 9/1960 | Byrne | 101/426 |
| 3,045,587 | 7/1962 | Schwertz | 101/1 |
| 3,124,483 | 3/1964 | Rheinfrank | 118/655 |
| 3,281,241 | 10/1966 | Mihajlov | 430/126 |
| 3,363,555 | 1/1968 | Olden | 101/426 |
| 3,429,701 | 2/1969 | Koehler | 430/31 |
| 3,508,823 | 4/1970 | Gundlach et al. | 355/3 R |
| 3,646,866 | 3/1972 | Baltazzi et al. | 355/16 X |
| 3,659,936 | 5/1972 | Klose et al. | 355/3 R |
| 3,888,664 | 6/1975 | Carlson et al. | 430/126 |
| 3,918,971 | 11/1975 | Zweig | 355/3 R |

*Primary Examiner*—R. L. Moses

*Attorney, Agent, or Firm*—Silverman, Cass & Singer, Ltd.

[57] ABSTRACT

Apparatus for obtaining multiple copies from apparatus including an electrophotographic member of the type in which the latent image is represented by charge not removed when toner is applied and thereafter transferred. The electrophotographic member with its latent image is repeatedly subjected to toning and transfer to respective multiple receptors without intervening charge and exposure. This may be done until the desired number of copies is made or until the image quality deteriorates by reason of dark decay. If additional copies are desired the electrophotographic member is again charged and exposed and thereafter toned and the image transferred repeatedly without intervening additional charge and exposure.

Structure is provided for performing other functions such as automatically sensing quality and responding to a condition which requires a new cycle of charge and expose.

8 Claims, 3 Drawing Figures

MULTIPLE COPY ELECTROPHOTOGRAPHIC REPRODUCING APPARATUS

This application is a divisional application of Ser. No. 909,433 filed May 25, 1978 now U.S. Pat. No. 4,241,160 which was a continuation application of Ser. No. 723,098 filed Sept. 14, 1976, which in turn was a continuation application of Ser. No. 517,173 filed Oct. 23, 1974, Ser. Nos. 723,098 and 517,173 now abandoned, Ser. No. 909,433 now pending all being owned by the same assignee.

CROSS REFERENCE TO RELATED APPLICATIONS

Reference is made herein to an electrophotographic member which is disclosed and claimed in copending U.S. application Ser. No. 434,699 filed Jan. 18, 1974 and entitled "Electrophotographic Film, Method of Making and Using the Same and Photoconductive Coating Used Therewith", now abandoned in favor of U.S. continuation application Ser. No. 704,780, filed July 13, 1976 and entitled "Electrophotographic Film, Method Of Making The Same And Photoconductive Coating Used Therewith", now U.S. Pat. No. 4,025,339.

BACKGROUND OF THE INVENTION

The invention is concerned generally with so-called copying machines on a method in which the same subject matter, such as for example a document, is to be repeated in multiple copies. Specifically, the invention relates to such copying machines which utilize the electrostatic principles of imaging.

Two type of presently used electrostatic copying machines are in general use, one operating on the basis of xerography and the other on the basis of that which is known as electrofax. The first type of device provides an electrophotographic member in the form of an amorphous selenium drum based upon metal, the selenium surface being charged, exposed to an image, toned and the toned image transferred to a receptor which usually consists of ordinary paper. After transfer, the image is fused to the paper by a heat lamp. The second type of device provides an electrophotographic member in the form of a sheet of conductive paper carrying a coating of zinc oxide in a resin matrix, the coating being charged and exposed to projected image after which the entire electrophotographic member is moved through a liquid toner bath and fused in the latter step of which it is dried. The entire member becomes the copy of the document or article which was copied.

In both cases, when multiple copies are required, the apparatus recycles, passing through the functions of charge, expose and tone. In the case of the xerographic apparatus the electrophotographic member is caused to transfer the toned image to the receptor, the receptor is fused and dispensed into a bin, the member is cleaned and discharged and the mechanism starts all over again to charge, expose, tone, etc. In the case of the electrofax apparatus, obviously since the copy is the electrophotographic member itself, the machine must go through the complete cycle from the very beginning and through to the dispensing of the toned electrophotographic member for each copy.

Although this invention is concerned only with apparatus in which there is a transfer of toner effected, both types of electrophotographic members will be discussed as a group and contrasted with a different type of electrophotographic member.

The charge which is placed upon the surface of the known type of electrophotographic member as used in the xerographic and electrofax apparatus is selectively dissipated by the light which is projected onto the surface to form the latent image, leaving a latent image of primarily positive charges in the first case and negative charges in the second case. When toned by applying the fine particles of suitably polarized carbons, resins, etc. constituting modern toners, the toner particles neutralize or absorb the charges constituting the latent image. If these particles are removed mechanically, as by transfer to a receptor, substantially no charge of any consequence remains on the surface of the electrophotographic member. Either the toning neutralizes the charge or absorbs it, probably the former.

Using this type of electrophotographic member it is seen that known electrostatic copying machines must be complex and expensive, must have expensive, long duty cycles and must have slow throughputs. The rate of reproduction is limited by the length of a complete duty cycle.

The invention contemplates the use of an electrophotographic member in which the charge applied thereto is not believed to reside on the surface but is believed to exist at or below the surface without in any way adversely affecting the surface effects of the charge. Such an electrophotographic member is of the type which is disclosed in the copending application and includes a crystalline, dense, inorganic photoconductive coating of a thin film semiconductor material applied by sputtering to a suitable ohmic layer and substrate and used to make multiple copies as described below. Since there are believed to be no charges sitting on the surface, there can be no neutralization of such charges by toner particles applied thereto and thereafter removed therefrom. The charge and hence the latent image will obtain so long as the quality thereof does not deteriorate on account of the characteristic dark decay of the coating. Until this deterioration is obvious in copies produced, the latent image once formed can be toned and transferred repeatedly without the need for again charging and exposing so that many copies can be made quickly on only one exposure.

Advantages accrue because of the fact that one charge and exposure will provide a great many copies at high speed. The duty cycle during the copy making period of time consists only of toning and transferring.

Many other advantages will occur to those in this art as a result of consideration of the detailed description hereinafter.

SUMMARY OF THE INVENTION

Apparatus for producing multiple copies from an electrophotographic member having a photoconductive coating of the type which will not lose charge to toner particles applied to the coating. The apparatus is provided with plural means capable of performing the steps of charging the coating with a suitable source of positive or negative ions to produce a uniform charge at or below the surface of the coating, exposing the coating to radiation from an object to achieve a latent image of said object in said charge through selective internal dissipation or recombination of parts of said uniform charge, applying toner particles to said surface and transferring the resulting toned image to a receptor and thereafter repeating the toner application and transfer without charging and exposing to achieve a plurality of copies. The apparatus operates to continue the toning and transfer until deterioration of the transferred image due to dark decay of the photoconductive coating, if desired, or may be furthered by subsequent charging and exposing followed by another group of multiple copies and so on.

The apparatus of the invention comprises means for charging, exposing, toning and transfer to a receptor in which there are means to continue operation of only the toning and transfer means of the apparatus. Likewise means may be provided to enable the renewal of the charging and exposing, if desired, between groups of copies made only by toning and transfer. Structure may be provided for the various functions needed such as paper supply and feed in synchronism with the apparatus, control of the charge and exposure means, etc. Means may be provided for sensing quality of the images transferred and causing the operation of the charge and exposure means from time to time between groups of copies made only by toning and transfer.

DESCRIPTION OF THE PREFERRED EMBODIMENTS

The invention revolves around the use of an electrophotographic member which has a photoconductive coating that does not lose charge to toner. In such a member, the charge produces a field or what may be considered an enormous number of fields on the surface of the photoconductive coating having the same action as the type of photoconductive coatings in which the charge produces ions that sit on the surface. This action comprises the attraction of suitably polarized toner particles. When the toner particles are removed from the type of coating in which ions sit on the surface, there is no longer an integrated charge remaining on the surface. On the other hand, when the toner particles are removed from the photoconductive coating that has the charge at or below the surface, the charge is not affected. Accordingly, such charge on the latter type of coating, whether it is a uniform charge or is represented by a latent image of an object being copied, will persist irrespective of the number of times it is toned and the toner removed until the quality of the image deteriorates due to the dark decay characteristic of the coating. This latter is not a function of the application or removal of toner particles but is a physical concept inherent in the coating itself.

The electrophotographic member and coating which is disclosed in the referenced application, now U.S. Pat. No. 4,025,339, is ideally suited for the invention herein. The photoconductive coating is a thin film, microcrystalline, inorganic, dense, sputtered semiconductor material and is believed to produce anisotropy of a remarkable nature. The crystallites forming the coating are orthogonally oriented relative to the substrate and are thus believed to produce a practically infinite number of individual fields at their apices on the surface. The constitution of the coating is such that the charge applied thereto is believed to enter into the coating and be trapped in suitable locations therein, being neutralized or caused to recombine only by radiation during exposure and not by surface contact with charged toner particles. When the toner particles are removed as by transfer the charged increments are not affected; hence the same latent image still remains and may be again toned and transferred over and over again many times without re-charging and re-exposing.

Figure 2:
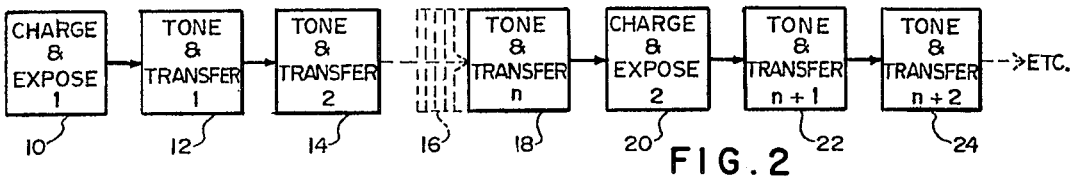
FIG. 2 is a block diagram showing by way of progression the steps constituting generally the method capable of being practiced by the invention.

The method performed by the apparatus of the invention is explained briefly in connection with FIG. 2 which shows a series of blocks representing a flow chart of steps from left to right. Block 10 represents two steps combined in order to render the diagram easy to follow. Actually these two steps are normally performed seriatim with the electrophotographic member being first charged by corona or the like and thereafter being exposed to the illumination produced by projecting the image of an object onto the electrophotographic member, that is, onto the photoconductive coating thereof. Thus block 10 is called "Charge and Expose". The next following block 12 is marked "Tone and Transfer, 1" this being the next two following steps in the production of a copy of the object. The surface of the photoconductive coating is toned either by dry or liquid toner which adheres in accordance with the latent charge image and thereafter a receptor member such as a sheet of paper is pressed against the coating and it picks up the toner to transfer the toned visible image to the surface of the paper.

The apparatus of the invention may include means to perform a fusing or fixing step thereafter but in other instances the toner may be suspended in a solvent which readily evaporates and leaves the toned image self-adhering without the need for fixing. The invention contemplates both types of toner and for simplicity no fixing step is referred to in the diagram of FIG. 2. It is presumed to be there if needed. In such case it would follow after the block 12.

In the known systems and methods such as exemplified by xerography the next step following the tone and transfer represented by block 12 would have to be again charge and expose if one wanted multiple copies. Each copy would go through the same duty cycle, requiring energizing of the high voltage corona circuit, operation of the optical mechanism and energization of the projector lamp and circuit. In addition, the mechanical apparatus needed to return mechanisms to initial positions at the beginning of the procedure could be complex. Thus, blocks 10 and 12 so far as described above are known. The only difference between the prior art and the invention is represented by the numeral "1" in the blocks 10 and 12.

The presence of the numeral "1" in blocks 10 and 12 is intended to signify that the pair of steps of block 12 will produce the first copy from the first pair of steps of block 10. The next block is 14 and again it is designated "Tone and Transfer" but this block is marked by the numeral "2". What this means is that immediately after the image has been transferred in block 12 it is again toned and the second image transferred to another receptor. This has been done out of the same first latent image achieved through the charge and expose steps of block 10.

The same two steps of tone and transfer are repeated over and over again, as indicated by the broken lines at 16 until the user decides he has enough copies. The last copy is then produced by the block 18 which is marked "Tone and Transfer, n", meaning that n copies have been made. If there has been no substantial decay of the charge due to the inherent dark decay characteristic of the electrophotographic member when the nth copy has been produced, the process may be stopped at the block 18. If on the other hand the user wants more copies than he has made by the process described and in his judgment, or in the judgment of a suitable densitometer measuring the copies it appears that copies after the nth will not be acceptable, he may again charge and image the electrophotographic member (block 20) and following that tone and transfer as described above (blocks 22 and 24). This may go on as long as desired.

It is noted that the blocks 22 and 24 are marked "Tone and Transfer, n+1" and "Tone and Transfer, n+2". The block 18 is marked "Charge and Expose, 2". The significance of this is that the number of copies which follow after the nth copy will be n+1, n+2, etc., but the group thus identified will be the second group, deriving from the first renewal of the charge and exposure which, of course, is the second such charge and exposure. This may continue so long as desired.

The requirements for apparatus for carrying out the method described above may be very simple and economical. They may be achieved in fully or partially automatic apparatus and may be arranged for linear movement or rotary movement. The apparatus may, if desired, be quite sophisticated.

Figure 1:
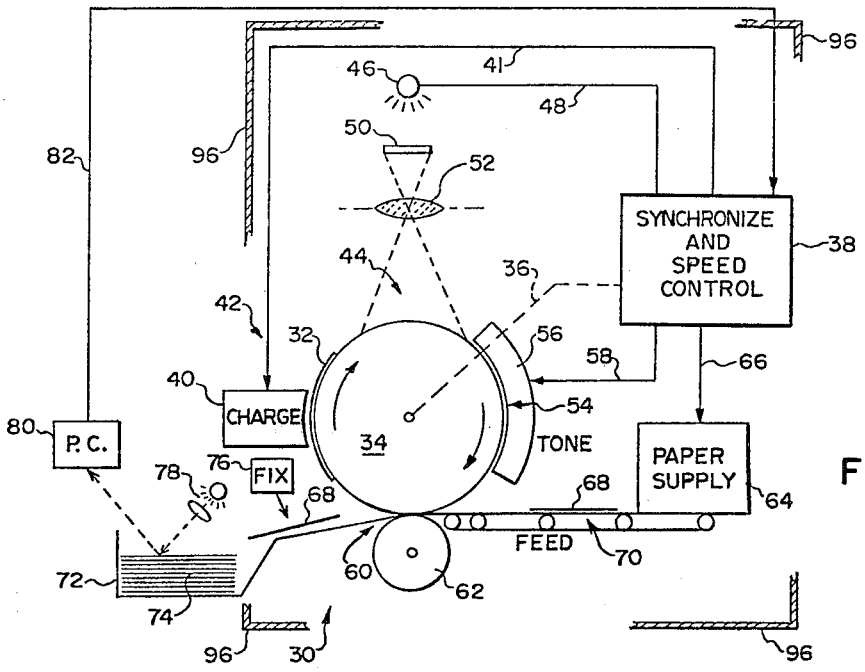
FIG. 1 is a highly schematic view and block diagram combined, showing apparatus of the invention.

In FIG. 1 there is diagrammed in a highly simplified form a rotary type of apparatus 30 for carrying out the invention. The electrophotographic member 32 is mounted on a suitable rotary cylinder 34 driven by some rotational mechanism at a controlled speed. This is indicated by the broken line 36 which extends to the block 38. Block 38 is marked "Synchronize and Speed Control" and as will be seen it represents controls and circuitry, manual, automatic or a combination thereof. It can represent power sources, drive and speed devices, etc. This type of apparatus is readily worked out by those skilled in the art in accordance with the functions desired which will be explained.

A charge device 40 operated through the channel 41 from the control or programmer 38 is disposed on the left of the cylinder 32 and charges the member 32 as the cylinder rotates in a clockwise direction indicated by the arrows. The charging may be done at what may be termed a charging station 42 and from this station the member 32 is carried around to the top of the cylinder 34 to the exposure station 44. Here a suitable light source 46 energized through the channel 48 illuminates an object 50 which in this case may comprise a transparency of a scene or document. The projected material is passed through a suitable optical train 52 and illuminates the charged surface of the electrophotographic member 32 at the proper timed relationship when the member 32 arrives at the exposure station. The resulting latent image may be applied by momentarily stopping the cylinder 34 or by suitable rocking mechanisms and optics which apply the image during movement of member 32 past the exposure station 44.

The now-exposed member 32 moves to the toning station 54 at which there is a toning mechanism 56 controlled from the control or programmer 38 by way of the channel 58. After toning, the member 32 is rotated down to the transfer station 60 at which point a back-up roller 62 is located. A paper supply 64 synchronized in operation through the channel 66 is arranged to feed a receptor such as a sheet of paper 68 along the paper feed 70 into the nip between the back-up roller 62 and the cylinder 34 just at the time that the toned member 32 arrives at the nip. As the paper member 68 goes through the nip the toned image is transferred to the paper surface and the completed paper copy falls into the bin 72. A stack of copies is shown at 74. If needed, fusing or fixing may be effected at 76, while the paper copy is on its way to the bin 72 or even in the bin.

The member 32 is now rotated around past the charging station 42 and the exposure station 44 but in the meantime, the control device 38 has deenergized the charging device 40 and the projecting lamp 46 (as well as any associated mechanisms) so that the toning station is reached without anything being done to the member 32. The toning mechanism 56 is operated, the toned image transferred to the next sheet of paper 68 and the partial duty cycle (i.e., without charging and exposing) is repeated again and again. Since there need be no steps other than tone and transfer, the control device 38 may automatically increase the speed of rotation of the cylinder 34 and synchronize operation of the toning mechanism 56 and paper feed 70 to suit.

The production of copies may continue until the user sees that the quality has deteriorated. He may stop the machine if he has sufficient copies before this occurs; he may manually operate the control device to restart the charge mechanism 40 and the exposure mechanism and lamp 46 so that he can commence a second series of copies; or he may do the latter automatically.

In the latter event, a densitometer represented by the spot projector 78 and photoresponsive device 80 (such as a photocell) is arranged to monitor the copies in the bin 72. When the density of the copied image deteriorates to produce a signal (or absence of signal) when compared with some adjustable standard (not shown) through the channel 82, the control mechanism 38 may be arranged to cause charge and exposure of the member 32 for one revolution only.

Other variations are readily worked out for modifications for different needs of a copying apparatus.

Figure 3:
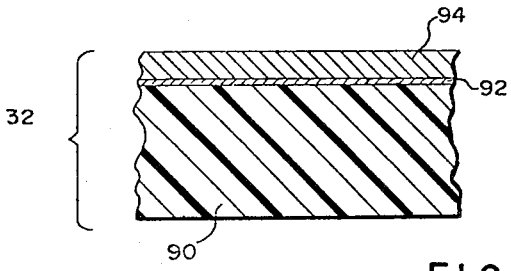
FIG. 3 is a fragmentary sectional view on a highly exaggerated scale of an electrophotographic member suitable for use with the invention.

FIG. 3 shows the electrophotographic member of the type disclosed in the copending application, now U.S. Pat. No. 4,025,339, which is ideally suited for use as the member 32. There is a substrate 90 which is of a synthetic resin (Mylar: Dupont) about 0.005 inch thick having an ohmic layer of tin-indium oxide 92 sputtered thereon of a thickness of several hundred Ångstroms. Upon this ohmic layer 92 is a dense, microcrystalline, sputtered coating 94 of cadmium sulfide about 2500 to 5000 Ångstroms thick. The cadmium sulfide comprises the photoconductive coating of the type described above and is one of several examples of inorganic, thin film coating that will produce the characteristics mentioned. The principal characteristic so far as this invention is concerned is the ability to hold charge at or below the surface of the coating rather than sitting on the surface so that toner particles applied and removed will not substantially affect the charge.

Obviously the steps of the invention are best carried out in darkness to delay dissipation of charge by any means other than inherent dark decay. Shrouds for the apparatus are presumed and are symbolically represented at 96. The reference to "ambient light" means external light not including the exposure means 44.

The particular electrophotographic member 32 described can be toned and transferred in about a second or less time. Once the photoconductive coating 94 has been charged and imaged (which may require about half a second or less) the copies can be made at a rate of about one a second. If the duty cycle included charge and expose, the cylinder could rotate at about one revolution every two seconds, but since the charge station 42 and and exposure station 44 are not used during the making of repeat copies, the rate of rotation of the cylinder 34 can be doubled. These exact figures for speed and rates are only by way of example and are subject to wide variation. The number of copies made from a single exposure can be from several to hundreds, depending on the materials, toners, etc.

As indicated previously, the operation of the apparatus may be carried out using a linearly moving mounting for the electrophotographic member 32. In such case there would be a carriage which reciprocates relative to the several stations, but does not return to the charging and exposure stations when in the repeat mode. Thus, assuming that the stations follow one another along a line, the reciprocal path of the carriage is half as long in the repeat mode as in the original full cycle mode.

Arrangements can be made in which the electrophotographic member is fixed and the apparatus carries the stations relative to it. Likewise, the electrophotographic member could be moved in a cycle which is both rectilinear and rotary, as for example, on an endless recycling belt.

The receptor can be any suitable article to which the toned image can be transferred, but normally it will be a sheet of paper. It could be a long roll or ribbon of paper which may or may not be cut into individual members either before or after transport. The paper supply may be a stack of sheets fed off one at a time. Other variations are feasible.

What it is desired to secure by Letters Patent of the United States is:

1. Apparatus for making multiple reproductions of the projected image of an object, said apparatus comprising:

(a) means carrying an electrophotographic member having a substrate with a photoconductive coating comprising an r.f. sputtered thin film, microcrystalline, wholly inorganic, dense, semiconductor material wherein the crystallites forming the coating are generally orthogonally oriented relative to the substrate, the coating having a dark resistivity of at least $10^{-14}$ ohm-centimeters and a ratio of dark and light resistivity of at least $10^4$ and being electrically anisotropic, the coating at least being capable of accepting a charge and holding said charge at or below the surface to the extent that the latent image which is capable of being achieved thereat is substantially unaffected by toner development or transfer, (b) a charging station having charging means proximate the coating for charging same only from the coating side of said member with a uniform charge at or below the surfae thereof and said coating being capable of holding the charge thereat, (c) an exposure station including image projection means located immediately following the charging station for exposing the charged coating after the completion of charging to a projected image of the object to achieve a latent charge image with the charge at or below the surface of the coating, (d) a toning station proximate the coating downstream from the exposure station and having toning means for toning the coating to achieve a visible toned image, (e) an image transfer station having transfer means for transferring the toned image to a receptor to achieve a copy of the projected image, (f) transport means for transporting the electrophotographic member and the respective stations relative to one another in a consecutive order seriatim for the operation of said respective means for charging, exposure, toning and transfer, said transport means being operative to repeat operation of the toning and transfer means while the charging and exposing means are disabled to provide second and more copies of the projected image in the absence of recharging and exposure and without heating or further charging to establish electric fields, the toning and transferring being effected while substantially maintaining the charge relationship and magnitude thereof along the dark decay curve characteristic of said photoconductive coating so that at least transfer is effected for plural copies without requiring supplementation of the fields representing the latent image, and means for controlling the operation of all said previously mentioned means in predetermined timed relation to one another.

2. Apparatus as claimed in claim 1 in which the transport means are rotary and the stations are disposed in circumferentially spaced relation about said transport means.

3. Apparatus as claimed in claim 1 in which said control means include speed control means arranged to disable operation of the charging and exposure means and to increase the speed of said transport means when repeat copies are being made.

4. Apparatus as claimed in claim 1 in which said control means include structure for disabling said charging and exposure means while repeat copies are being made, in which a densitometer is provided to monitor the image after transfer and provide a signal responsive to the density of the copy image as related to a predetermined standard and in which said last mentioned structure is operated by said signal to enable said charging and exposure means for one repeat thereof only.

5. Apparatus as claimed in claim 4 in which the transport means are rotary, the stations are disposed in circumferentially spaced relation about said transport means and in which the enabling of said charging and exposure means is effective for only one revolution of said transport means.

6. Apparatus as claimed in claim 1 including means to fix the transferred toned image.

7. The apparatus as claimed in claim 1 in which each said receptor comprises an independent sheet member.

8. The apparatus as claimed in claim 7 in which there is a receptor supply and said receptor moving means comprise a sheet feeding device arranged to move sheet members from the receptor supply into said transfer station.

* * * * *